US010641486B2

(12) United States Patent
Luo

(10) Patent No.: US 10,641,486 B2
(45) Date of Patent: May 5, 2020

(54) REFILLABLE GAS LIGHTER

(71) Applicant: ARROW LIGHTER INC., City of Industry, CA (US)

(72) Inventor: Zhuo Wen Luo, City of Industry, CA (US)

( * ) Notice: Subject to any disclaimer, the term of this patent is extended or adjusted under 35 U.S.C. 154(b) by 174 days.

(21) Appl. No.: 15/990,562

(22) Filed: May 25, 2018

(65) Prior Publication Data

US 2019/0360692 A1 Nov. 28, 2019

(51) Int. Cl.
*F23Q 2/16* (2006.01)
*F23Q 2/28* (2006.01)

(52) U.S. Cl.
CPC ..... *F23Q 2/287* (2013.01); *F23Q 2/16* (2013.01)

(58) Field of Classification Search
CPC . F23Q 2/287; F23Q 2/16; F23Q 2/285; F23Q 2/36; F23Q 2/50
See application file for complete search history.

(56) References Cited

U.S. PATENT DOCUMENTS 4,190,034 A * 2/1980 Wonisch ..... F23Q 13/04 126/25 B
6,945,773 B2 * 9/2005 Adams ..... F23Q 2/164 431/153
2009/0278494 A1 * 11/2009 Randall ..... H02J 7/0044 320/114

* cited by examiner

*Primary Examiner* — Alfred Basichas
(74) *Attorney, Agent, or Firm* — Charles C. H. Wu; Wu & Reddy, A Prof. Corp.

(57) ABSTRACT

A refillable gas lighter comprises a rear case, a front case and a barrel. The lighter is provided with a physical phenomenon of piezo-electric effect to generate the electric spark. Inside the rear case, the pusher is pressed down to the gas tank with the pusher having a plurality of conducting strips that acts as an electrical conductor connected to the gas tank. A copper wire carrying negative charge is connected with a bridge plate that passes through the conductive hose to achieve fuel distribution and electric conduction. The conductive hose transfers the igniting gas from the gas tank to the spark plug, where the ignition initiates the flame. The housing assembly includes a rear case with a rear case neck, a front case with a front case neck, and a barrel. The housing assembly is further locked together by means of a barrel sleeve where the barrel has a flame opening to ignite.

21 Claims, 5 Drawing Sheets

REFILLABLE GAS LIGHTER

BACKGROUND OF THE DISCLOSURE

Technical Field of the Disclosure

The present disclosure relates to refillable gas lighters, and more particularly to a multipurpose, refillable gas lighter used to ignite a gas stove or BBQ grill.

Description of the Related Art

A refillable gas lighter is a portable device that is commonly used at homes for igniting stoves and other variety of combustion materials like barbecue, fireworks etc. Many of the lighters are very useful and common in the present market. It uses a physical phenomenon called piezo-electric effect to generate an electric spark which ignites the combustible gas from the stove burner. The phenomenon of piezo-electric charge is the electric charge that accumulates in some materials in response to high pressure. An electric spark is usually generated once per turn of the knob or press of the button.

Several methods have been developed in the art; one such method describes a utility lighter for barbecue purpose having a resistance unit designed to resist the depressing force applied on the trigger. However, as the depressing force is resisted by the resistance unit, it requires an adult to apply more force to the trigger to ignite the barbecue lighter which in turn damages the components inside the lighter.

Another method discloses a utility lighter having an ignition-resistant mechanism. The ignition-resistant function is performed by a cam mechanism. Even though the structure of cam mechanism provides an optimum amount of safety, it is very difficult for young and old people to operate. Moreover, this type of lighter has a complex construction that increases the maintenance cost.

Yet another gas lighter with safety button allows the user to regulate the outflow of gas to generate a flame. However, while keep pressing on the button, the user may feel tired and the thumb may be easily hurt by the flame. Besides, once the button is released, the flame will immediately go out.

There is thus a need for a wireless, refillable gas lighter to ignite the gas stove or a barbecue grill. This refillable gas lighter would work with the principle of wireless electronics. The present embodiment would use a conductive plate instead of enameled wire as an electrical conductor. Such a refillable gas lighter uses a reverse wireless electronic power supply with a compact structure and is weightless. Further, such a refillable gas lighter would have a plurality of conductors in fixed shape which would make it easy to assemble with automated assembly. Also this refillable gas lighter would have an innovative structure. Present embodiment overcomes the prior art shortcomings in this area and accomplishes these and other critical objectives.

SUMMARY OF THE DISCLOSURE

To minimize the limitations found in the prior art, and to minimize other limitations that will be apparent upon the reading of the specification, the preferred embodiment of the present invention provides a multipurpose, refillable gas, lighter for providing a flame for a gas stove or a barbecue grill. The refillable gas lighter has the capability for refilling the gas lighter with multiple times of its usage. The structural design is different from traditional barbecue lighters, is a portable lighter with compact structure, and is light in weight.

The refillable gas lighter comprises a front case, a rear case, a barrel, and a barrel sleeve. A housing is formed by joining a rear case with a rear case neck and a front case with a front case neck. A barrel slides over and interlocks with the front case neck and the rear case neck, and has a flame opening at one end to ignite. A barrel sleeve then slides over the barrel to securably hold the barrel, the rear case neck, and the front case neck in their joined position. The barrel sleeve is cylindrical in shape and is configured to fit the barrel and the portion of the housing joined with the barrel or from which the barrel extends. Inside the rear case, a pusher is connected with a plurality of conducting strips that acts as an electrical conductor. When the pusher is pressed down to the gas tank, inside the gas tank piezo-electric energy is generated, where positive charge is formed in the first conducting strip and passes through the second conducting strip to the spark spring. The pusher is connected with a plurality of conducting strips positioned on the gas tank being connected with a bridge plate. The copper wire connected from the bridge plate carries the energized negative charge through the conductive hose extends to the tip of the barrel where the spark spring is attached. The conductive hose being configured to transfer igniting gas from the gas tank, a flame opening having a spark spring for ignition. The first conducting strip and the second conducting strip, both act as an electrical conductor in this refillable gas lighter which is connected to the spark spring. The spark spring functions as a means for conducting the charges and initiates ignition utilizing a reverse wireless electronic power supply.

A first objective of the present invention is to provide a refillable gas lighter that can easily refill the gas and reuse multiple times.

A second objective of the present invention is to provide a refillable gas lighter that is a portable refillable gas lighter, compact in design and light in weight.

Another objective of the present invention is to provide a refillable gas lighter that utilizes a reverse wireless electronic power supply.

These and other advantages and features of the present invention are described with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention, thus the drawings are generalized in form in the interest of clarity and conciseness.

DETAILED DESCRIPTION OF THE DRAWINGS

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

As used herein, the singular forms "a", "an" and "the" include plural referents unless the context clearly dictates otherwise. "And" as used herein is interchangeably used with "or" unless expressly stated otherwise. As used herein, the term 'about" means +/−5% of the recited parameter. All embodiments of any aspect of the invention can be used in combination, unless the context clearly dictates otherwise.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to". Words using the singular or plural number also include the plural and singular number, respectively. Additionally, the words "herein," "wherein", "whereas", "above," and "below" and words of similar import, when used in this application, shall refer to this application as a whole and not to any particular portions of the application.

The description of embodiments of the disclosure is not intended to be exhaustive or to limit the disclosure to the precise form disclosed. While the specific embodiments of, and examples for, the disclosure are described herein for illustrative purposes, various equivalent modifications are possible within the scope of the disclosure, as those skilled in the relevant art will recognize.

Figure 1:
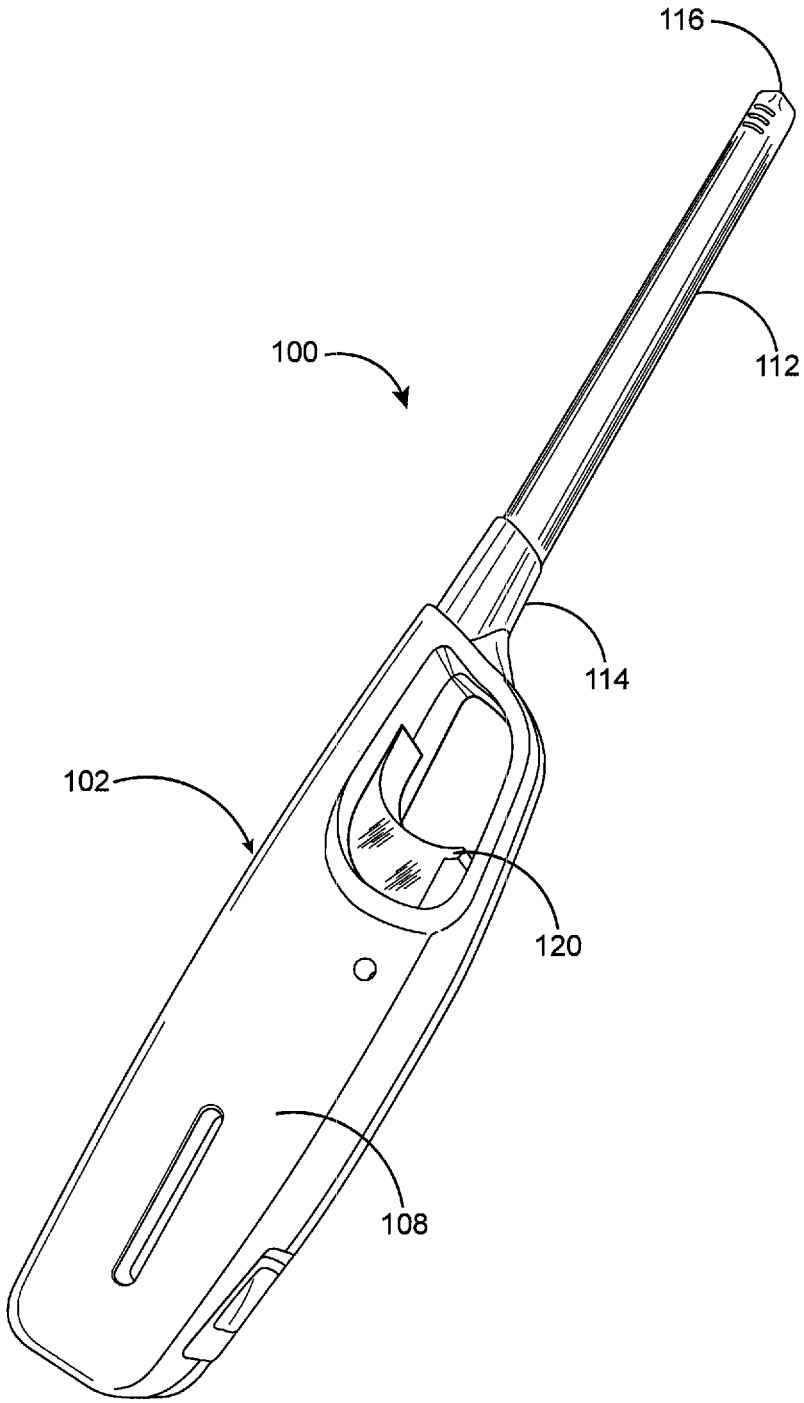
FIG. 1 illustrates a front perspective view of a refillable gas lighter for igniting a stove or a barbecue grill in accordance with the preferred embodiment of the present invention.
Figure 2:
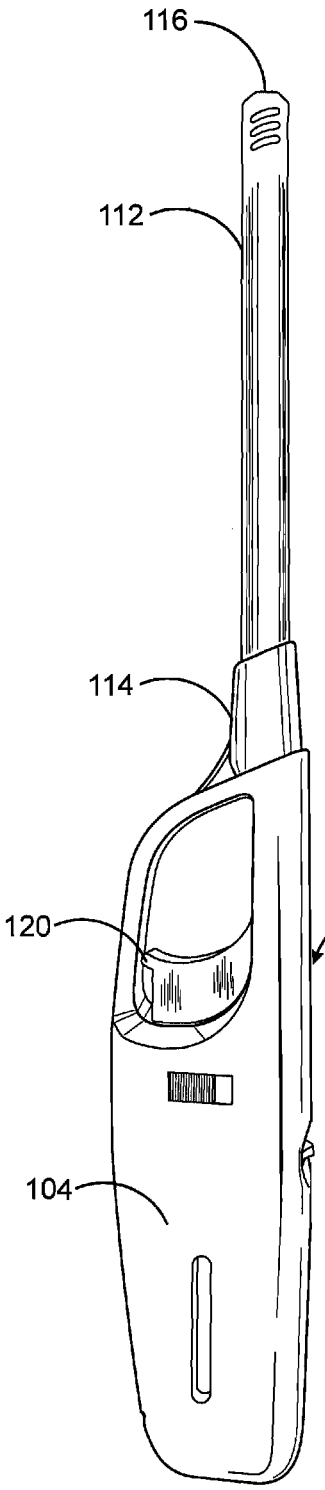
FIG. 2 illustrates a left side view of the refillable gas lighter for igniting a stove or a barbecue grill in accordance with the preferred embodiment of the present invention.
Figure 3:
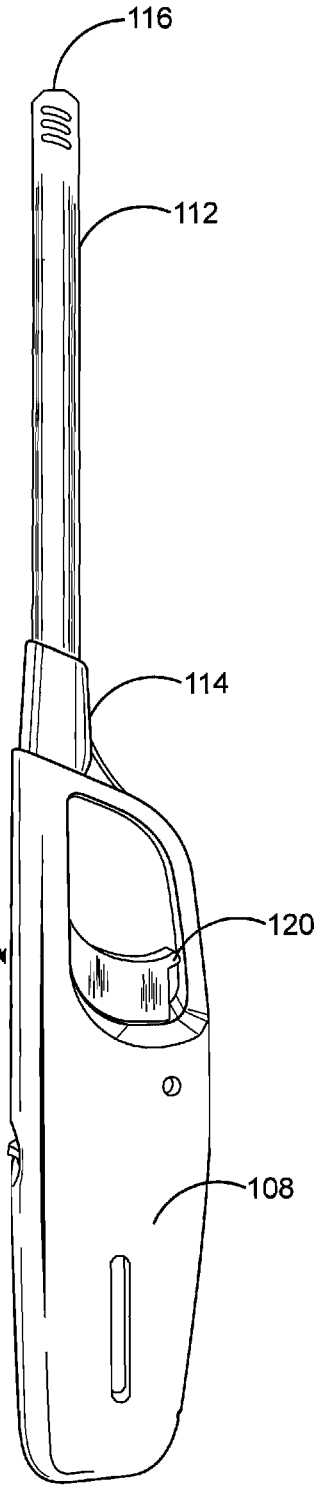
FIG. 3 illustrates a right side view of the refillable gas lighter for igniting a stove or a barbecue grill in accordance with the preferred embodiment of the present invention.

Referring to FIGS. 1-3, FIG. 1 illustrates a front perspective view of a refillable gas lighter 100 for igniting a stove or a barbecue grill in accordance with the preferred embodiment of the present invention. The refillable gas lighter 100 is used to ignite the gas stove or a barbecue grill. The refillable gas lighter 100 consists of a housing 102 having a rear case 104 with a rear case neck 106, a front case 108 with a front case neck 110, and a barrel 112 that slides over and interlocks with the rear case neck 106 and the front case neck 110 joining them together. The housing 102 is locked in position at the joining of the front case neck 110, the rear case neck 106 and the barrel 112, by means of a barrel sleeve 114. The barrel 112 having a flame opening 116 to ignite the gas stove or a barbecue grill. The refillable gas lighter 100 also includes a gas tank 118 for refilling gas and a pusher 120 having a plurality of conducting strips 122 that acts as an electrical conductor positioned on the gas tank 118 which is connected with a bridge plate 128. The bridge plate 128 is configured to pass a plurality of charges. The plurality of conducting strips 122 includes a first conducting strip 124 and a second conducting strip 126. The refillable gas lighter 100 consists of a conductive hose 130 having a copper wire 132 that extends towards a spark spring 134. The conductive hose 130 having the copper wire 132 configured to achieve two-in-one function at same time like fuel distribution and electric conduction. The conductive hose 130 configured to transfer igniting gas from the gas tank 118. The refillable gas lighter 100 ignites the barbecue grill utilizing a reverse wireless electronic power supply.

Figure 4A:
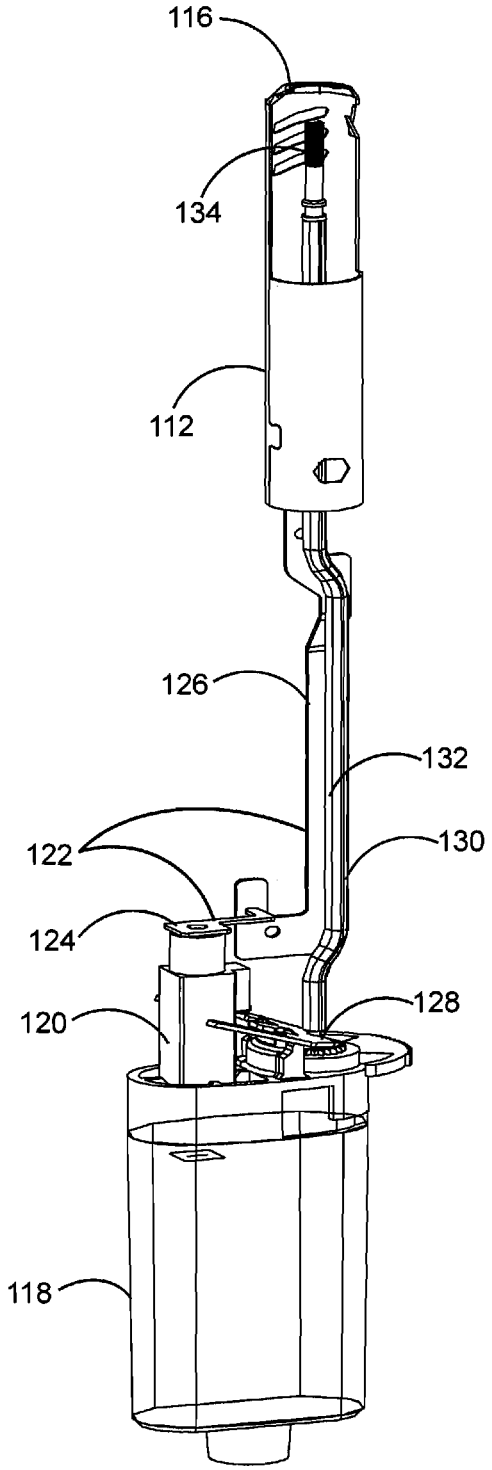
FIGS. 4A and 4B illustrate schematic diagrams of the refillable gas lighter for igniting a stove or a barbecue grill in accordance with the preferred embodiment of the present invention.
Figure 4B:
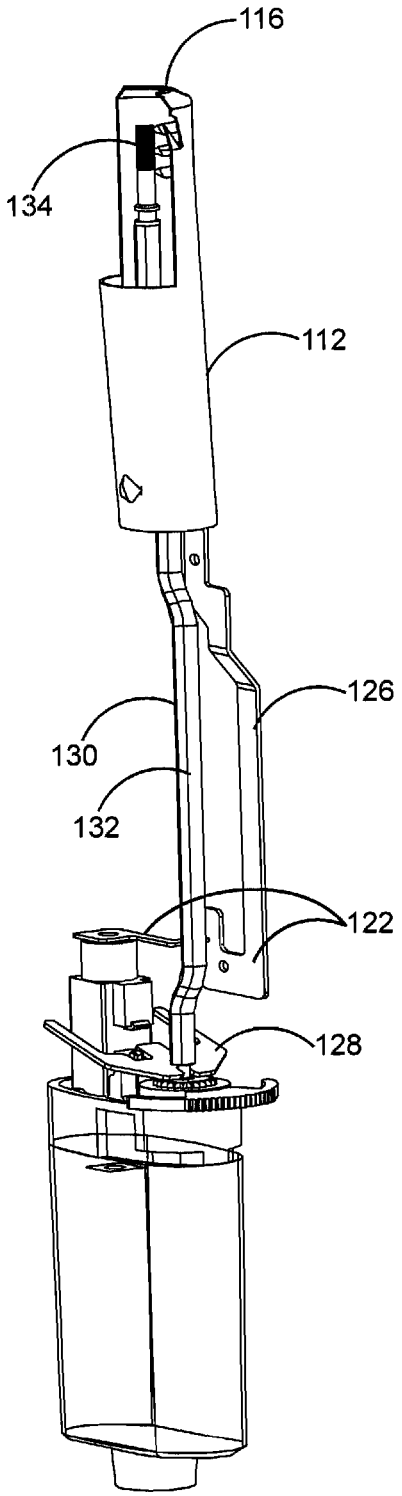

Referring to FIG. 4A and FIG. 4B, illustrate a schematic diagram of the refillable gas lighter 100 for igniting a gas stove or a barbecue grill in accordance with the preferred embodiment of the present invention. The pusher 120 is connected with the plurality of conducting strips 122. When the pusher 120 is pressed down to the gas tank 118, inside the gas tank 118, a piezo-electric energy is generated. The positive charge is formed in the first conducting strip 124 and passes through the second conducting strip 126 to the spark spring 134. The pusher 120 is connected with the plurality of conducting strips 122 positioned on the gas tank 118 connected with the bridge plate 128. The copper wire 132 connected from the bridge plate 128 carries the energized negative charge through the conductive hose 130 extends to the tip of the barrel 112 where the spark spring 134 is attached to. The conductive hose 130 is configured to transfer igniting gas from the gas tank 118 which extends to the spark spring 134 for ignition. The first conducting strip 124 and the second conducting strip 126 are connected with the spark spring 134. Both positive and negative charges passed to the spark spring 134 causes to form ignition. The refillable gas lighter 100 ignites the stove or a barbecue grill utilizing a reverse wireless electronic power supply.

Figure 5:
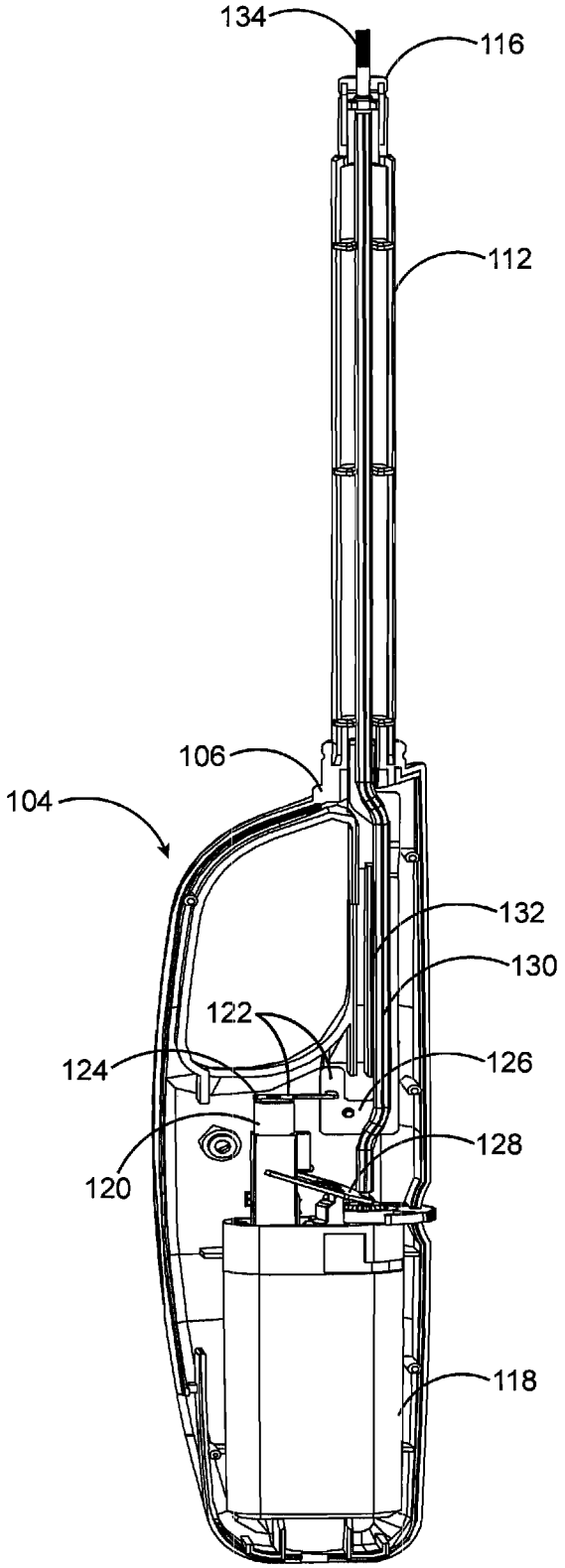
FIG. 5 illustrates a cross sectional view of the refillable gas lighter positioned in the rear case in accordance with the preferred embodiment of the present invention.

FIG. 5 illustrates a cross sectional view of the refillable gas lighter 100 positioned in the rear case 104 in accordance with the preferred embodiment of the present invention. When the pusher 120 press downwards to the bridge plate 128 connected along with the pusher 120 press downwards. A positive charge is generated due to piezo-electric effect. The positive charge transfers from the second conducting strip 126 to the spark spring 134. The copper wire 132 connected from the bridge plate 128 carries the negative charge through the conductive hose 130 extends to the tip of the barrel 112 where the spark spring 134 is attached to. The negative charge transfers through the copper wire 132 along the conductive hose 130 to the tip of the nozzle. The conductive hose 130 being configured to transfer igniting a gas from the gas tank 118, and a flame opening having a spark spring 134 for ignition. The first conducting strip 124 and the second conducting strip 126 are connected with the spark spring 134 where both positive and negative charge reaches at the spark spring 134 that causes ignition.

Figure 6:
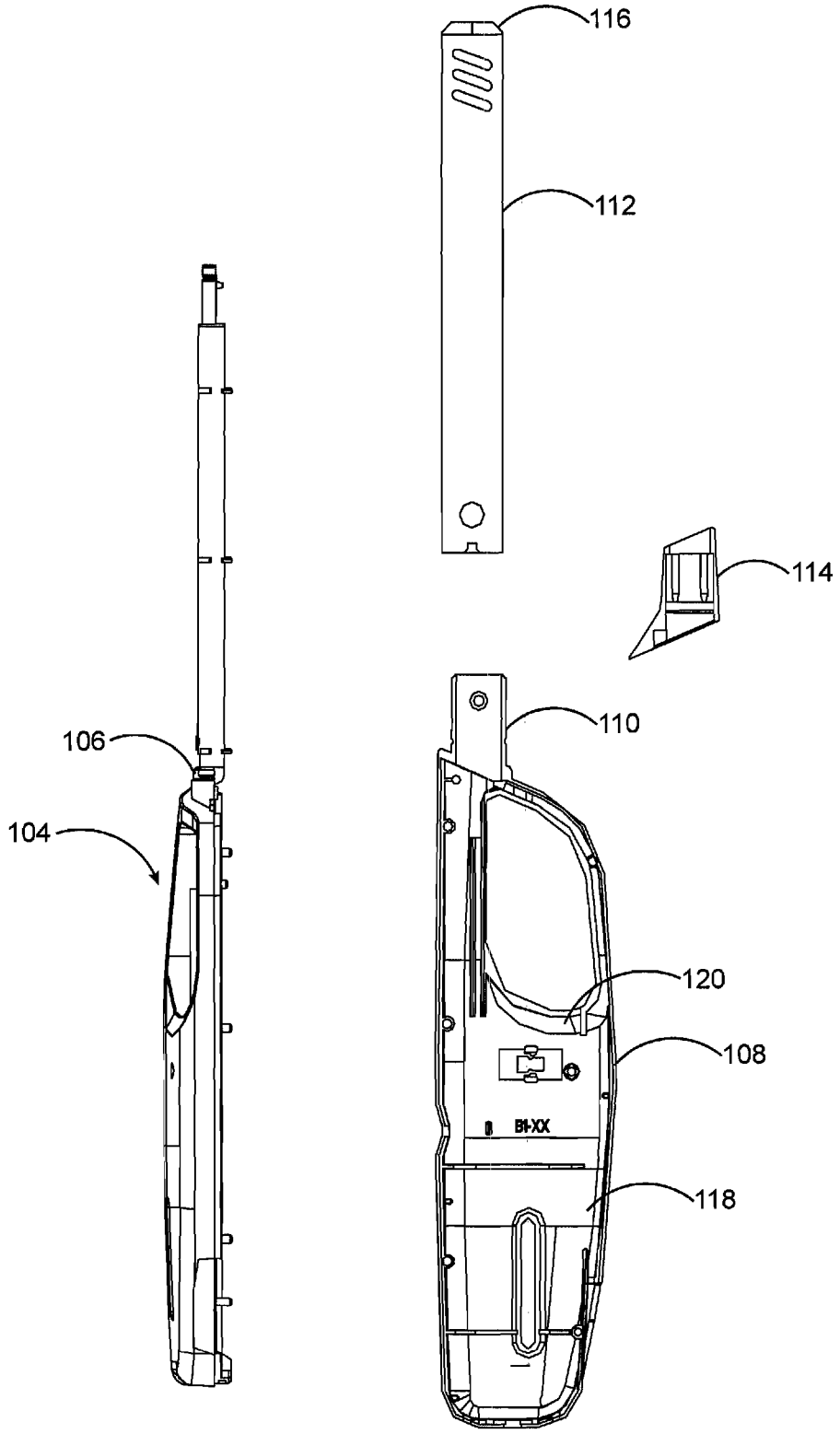
FIG. 6 illustrates an exploded view of the refillable gas lighter positioned in the separation of rear case, front case, barrel sleeve and the barrel in accordance with the preferred embodiment of the present invention.

FIG. 6 illustrates an exploded view of the refillable gas lighter 100 wherein the rear case 104, the front case 108, the barrel 112, and the barrel sleeve 114 are separated in accordance with the preferred embodiment of the present invention. The bottom portion of the gas tank 118 and the barrel 112 permanently hold all of the parts including the conductive hose 130, which makes the assembly simple. The refillable gas lighter 100 is simple and fixation of the barrel 112 by sliding it over the rear case neck 106 and matching the lock from the rear case 104 and the front case 108 holds the conductive hose 130 in place during assembly of the refillable gas lighter 100. The barrel sleeve 114 holds the barrel 112, the rear case neck 106 and the front case neck 110 in their joint positions.

The foregoing description of the preferred embodiment of the present invention has been presented for the purpose of illustration and description. It is not intended to be exhaustive or to limit the invention to the precise form disclosed. Many modifications and variations are possible in light of the above teachings. It is intended that the scope of the present invention not be limited by this detailed description, but by the claims and the equivalents to the claims appended hereto.

What is claimed is:

1. A refillable gas lighter for ignite comprising:

a housing having a rear case with a rear case neck, a front case with a front case neck and a barrel, the housing configured by sliding the barrel over the rear case neck and locking the barrel, the front case and the rear case together by means of a barrel sleeve, the barrel having a flame opening to ignite;

a gas tank for refilling gas;

a pusher having a plurality of conducting strips that acts as an electrical conductor the plurality of conducting strips consist of a first conducting strip and a second conducting strip being positioned on the gas tank being connected with a bridge plate; and a conductive hose having a copper wire configured to achieve fuel distribution and electric conduction, the conductive hose configured to transfer igniting gas from the gas tank;

whereby the refillable gas lighter ignites flame utilizing a reverse wireless electronic power supply.

2. The refillable gas lighter of claim 1 wherein the bridge plate is configured for passing a plurality of charges.

3. The refillable gas lighter of claim 2 wherein the plurality of charges includes a positive charge and a negative charge.

4. The refillable gas lighter of claim 1 wherein when the pusher is pressed down inside the gas tank, a piezo-electric energy is generated.

5. The refillable gas lighter of claim 4 wherein when the pusher is pressed down, the negative charge is energized due to the pressure formed inside the gas tank.

6. The refillable gas lighter of claim 1 wherein when the pusher is pressed down the positive charge is energized in the first conducting strip.

7. The refillable gas lighter of claim 6 wherein the energized positive charge passes through the second conducting strip.

8. The refillable gas lighter of claim 1 wherein the flame opening further includes a spark spring for ignition.

9. The refillable gas lighter of claim 1 wherein the copper wire carries the negative charge through the conductive hose to the spark spring.

10. The refillable gas lighter of claim 1 wherein the first conducting strip and the second conducting strip are connected with the spark spring.

11. The refillable gas lighter of claim 1 wherein both positive and negative charges are attached together in the spark spring to form ignition.

12. A refillable gas lighter for igniting a flame comprising:

a housing having a rear case with a rear case neck, a front case with a front case neck and a barrel;

a barrel sleeve configured to slide over the barrel and join the front case neck, the rear case neck and the barrel and hold them in place;

a gas tank for refilling gas to ignite;

a pusher having a plurality of conducting strips that acts as an electrical conductor positioned on the gas tank, the plurality of conducting strips being connected with a bridge plate, the bridge plate being configured to pass a plurality of charges;

a conductive hose having a copper wire extending therethrough configured to achieve two-in-one fuel distribution and electric conduction, the conductive hose being configured to transfer igniting gas from the gas tank; and a flame opening having a spark spring for ignition;

whereby the refillable gas lighter ignites a gas stove or a barbecue grill utilizing a reverse wireless electronic power supply.

13. The refillable gas lighter of claim 12 wherein the plurality of conducting strips that acts as an electrical conductor includes a first conducting strip and a second conducting strip.

14. The refillable gas lighter of claim 13 wherein the plurality of charges includes a positive charge and a negative charge.

15. The refillable gas lighter of claim 12 wherein when the pusher is pressed down, piezo-electric energy is generated inside the gas tank.

16. The refillable gas lighter of claim 15 wherein when the pusher is pressed down, a negative charge is energized due to the pressure formed inside the gas tank.

17. The refillable gas lighter of claim 12 wherein the energized positive charge passes through the second conducting strip.

18. The refillable gas lighter of claim 17 wherein the generated positive charge passes through the second conducting strip.

19. The refillable gas lighter of claim 12 wherein copper wire carries with the negative charge through the conductive hose to the spark spring.

20. The refillable gas lighter of claim 12 wherein the first conducting strip and the second conducting strip are connected with the spark spring.

21. The refillable gas lighter of claim 12 wherein both positive and negative charges collide at the spark spring to form ignition.

* * * * *